United States Patent [19]

Beck et al.

[11] Patent Number: 4,785,957

[45] Date of Patent: Nov. 22, 1988

[54] COLLAPSIBLE SHIPPING CONTAINER

[76] Inventors: James R. Beck, 1665 Paullus Ave., Memphis, Tenn. 38127; John D. Sunderland, 7207 N.W. Donovan Dr.-Apt. 1623, Kansas City, Mo. 64153

[21] Appl. No.: 86,885

[22] Filed: Aug. 19, 1987

[51] Int. Cl.[4] ..... B65D 6/16

[52] U.S. Cl. ..... 220/4 F; 206/503; 206/600

[58] Field of Search ..... 206/386, 600, 511, 503; 217/12 R, 13, 5, 65; 220/4 F, 4 R

[56] References Cited

U.S. PATENT DOCUMENTS

| | | | |
|---|---|---|---|
| 2,667,398 | 1/1954 | Clafin | 220/4 F |
| 2,725,087 | 11/1955 | Potter | 206/600 |
| 3,246,828 | 4/1966 | Branscum et al. | 220/4 F |
| 3,371,816 | 3/1968 | Ricci | 206/511 |
| 3,464,577 | 9/1969 | Kinnon | 217/65 |
| 3,982,650 | 9/1976 | Ichihara | 220/4 F |
| 3,986,659 | 10/1976 | Vajtay | 220/4 F |
| 4,238,044 | 12/1980 | Rodder | 220/4 F |
| 4,560,079 | 12/1985 | Eddleston et al. | 220/4 F |

FOREIGN PATENT DOCUMENTS

| | | | |
|---|---|---|---|
| 2435351 | 2/1976 | Fed. Rep. of Germany | 220/4 F |
| 2916871 | 11/1980 | Fed. Rep. of Germany | 220/4 F |

*Primary Examiner*—Jimmy G. Foster

*Attorney, Agent, or Firm*—Gunn, Lee & Jackson

[57] ABSTRACT

A collapsible shipping container having a base structure provided with upstanding wall catches capable of being received in structurally interfitting relation within respective pockets defined within side walls thereof. A cover structure is provided with depending wall catches which are received within respective upwardly directed pockets of the side walls, thus securing the base structure to the side walls and the cover to the side walls. The cover structure is also provided with shipping catches which are received within shipping catch slots or openings defined within the base structure in the collapsed condition of the shipping container. In this condition the walls are stacked on the base structure and are restrained by the shipping catches and wall catches to secure the walls within the collapsed shipping container for shipping and handling in the collapsed condition thereof. The base structure is provided with spill guard strips which define space perimeters within which are received the lower ends of the wall structures to thus provide an appropriate seal to prevent entry of water and other liquid into the shipping container. The walls of the shipping container interfit at the corners thereof to define structurally interrelated corners that provide exceptional strength and which seal the corner sections against entry of water and other contaminants.

12 Claims, 4 Drawing Sheets

COLLAPSIBLE SHIPPING CONTAINER

FIELD OF THE INVENTION

This invention relates generally to shipping containers and more specifically to shipping containers capable of providing physical protection of products being shipped and to prevent theft of products during shipping. The shipping container facilitates efficiency of product handling during shipping and, when not in use and when being shipped or handled empty, is collapsible to a reduced height dimension while maintaining efficient structural integrity to permit multilevel stacking thereof.

BACKGROUND OF THE INVENTION

Container shipping of products has gained wide acceptance in the market in recent years. Use of shipping containers permits efficiency of handling and thus lower cost shipping even when the products being shipped and handled are of diverse character. Shipping containers are typically provided in conventional sizes to readily fit allocated spaces in trucks, railway vehicles, marine vessels, etc. Shipping containers permit the shipping of various size products and products of diverse characters since the containers provide structural walls to retain and protect the products.

Where products are prepared on pallets for shipment, even when the palletized products are encapsulated by a protective covering, there has been a problem of pilferage during shipping. Even when products are contained within protective shipping containers the only means to insure against pilferage is to provide appropriate container seals. If a container seal is broken upon arrival of the container at its destination, the shipper will typically be liable for the loss in the event pilferage has occurred.

Although shipment of products in shipping containers has gained wide acceptance in the transportation industry, empty containers represent a significant problem from the standpoint of handling, storage and maintenance. An empty shipping container typically requires as much storage space as when full and therefore a significant amount of storage space is required. Even when shipping containers are stored outdoors, a significant amount of storage space is required. The cost of this storage space represents a significant burden to the shipping industry. This financial burden is of course passed on through the shipper to the ultimate consumer along with other costs of shipping. When shipping containers are stored in an outdoor environment, they tend to deteriorate from exposure to weather conditions. During handling, shipping containers are often damaged. Thus significant maintenance expense is required which is of course passed on to the ultimate consumer of the goods being shipped. It is desirable therefore to provide an effective shipping container system that requires less storage space than is typical for empty shipping containers, thus permitting them to be stored in a more protective environment when not in use. It is also desirable to provide a shipping container system wherein the shipping containers are of reduced dimension when empty, thereby permitting ease of storage, handling and returning to the shipper.

THE PRIOR ART

Various collapsible or knock-down type shipping container have been provided which may be disassembled or folded to a substantially flat condition when empty. When the shipping container are disassembled, it is quite easy for its various structural components to become separated and lost. Accordingly, it is desirable to provide a collapsible shipping container which is capable of taking the form of a reduced dimension storage container which self contains all of its component parts and prevents them from being lost or damaged during handling in the collapsed condition.

SUMMARY OF THE INVENTION

It is a primary feature of the present invention to provide a novel collapsible shipping container which may be collapsed to a reduced dimension when empty to thus conserve storage space and reduce shipping space for the empty container.

It is also a feature of this invention to provide a novel collapsible shipping container which, in its collapsed condition, contains all of its component parts and thus prevents loss of the parts during shipping and handling when empty.

It is another feature of this invention to provide a novel collapsible shipping container which, when assembled for the shipping of goods, is capable of receiving one or more seals which verify the integrity of the shipping container during shipment and thus insure against liability of the shipper for products contained and protected by the collapsible shipping container.

It is another important feature of this invention to provide a novel collapsible shipping container which, both in its assembled and collapse conditions, is capable of withstanding application of significant weight and thus enables the assembled or collapsed shipping container to be stacked both during shipping and storage.

It is also a feature of this invention to provide a novel collapsible shipping container comprising various structural components which are easily replaced when damaged to thus insure against any necessity to remove the entire container to a repair facility when a part thereof becomes damaged.

It is another feature of this invention to provide a novel collapsible shipping container which is light weight, durable and is corrosive resistant to a significant degree and which provides effective protection against water damage in the event the container is exposed to rain and other weather conditions during shipment, handling and storage.

Briefly, a preferred embodiment of the present invention may conveniently take the form of a shipping container structure having a base, a top wall and four side walls. The base and top wall interfit with the side walls in a structurally interconnected relation such that the assembled container is rendered extremely rigid and durable and is capable of withstanding significant weight when stacked. The base structure includes a number of upstanding wall catches which are each received within respective wall catch slots formed in the side walls. The wall catches are tapered and interfit with respective tapered surfaces formed within the wall slots to thereby provide a force transmitting rigid structure that will withstand significant weight. The peripheral portions of the base define liquid protector rails or strips which interact with the wall structure to provide an effective liquid seal. This feature protects the products stored within the containers from being contaminated by water or other liquids that might come into contact with the shipping container.

The top wall structure of the shipping container is also provided with a plurality of downwardly projecting catch devices which are each received within appropriate wall slots or pockets in the same manner as the lower base catches are received. The wall catches of the top wall structure are also tapered and interfit within tapered slots or pockets in the wall structure to provide an efficient force transmitting component of the wall structure that is capable of withstanding considerable weight.

The top wall or cover is provided with a plurality of shipping catches which depend from the top wall to a greater extent than the wall catches. The shipping catches of the top wall are receivable within respective shipping catch receptacles of the base structure such that there is formed a structural interconnection between the to wall and base that is capable of withstanding significant weight. This feature provides collapsed shipping containers with efficient structural integrity and therefore enables stacking of collapsible shipping containers several tiers high when empty.

The various side will structures are designed to interfit when in assembly such that a strong substantially sealed corner joint is defined. The liquid or spill guard strips of the base structure assist in securing the corners of the side walls in intimate assembly for efficient protection of the products of the container during shipment, storage and handling.

In the collapsed condition of the container the side walls are stacked on the base structure and are secured against lateral movement by the wall catches of the base and by the shipping catches. Thus, in the collapsed condition of the shipping container, the wall structures are efficiently protected against loss or damage during shipment and handling of the shipping container.

The various features, advantages and objects of the present invention will become apparent to one skill in the art upon full consideration of the present disclosure. The form of the invention which now be described in detail illustrates the general principles of the invention but it is to be understood that this detailed description is not to be taken as limiting the scope of the present invention.

BRIEF DESCRIPTION OF THE DRAWINGS

So that the manner in which the above recited features, advantages and objects of this invention, as well as others which will become apparent, are attained and can be understood in detail, more particular description of the invention briefly summarized above may be had by reference to the embodiment thereof which are illustrated in the appended drawings, which drawings form a part of this specification.

It is to be noted, however, that the appended drawings illustrate only a typical embodiment of this invention and are therefore not to be considered limiting of its scope, for the invention may admit to other equally effective embodiments.

In the Drawings:

FIG. 1 is an isometric illustration of a shipping container constructed in accordance with the present invention and being shown in the assembled condition thereof;

FIG. 2 is an isometric illustration of the shipping container of FIG. 1 in the collapsed condition thereof;

FIG. 3 is a plan view of the base portion of the shipping container of FIGS. 1 and 2;

FIG. 4 is an elevational view of one of the side walls of the shipping container;

FIG. 5 is a sectional view taken along line 5—5 of FIG. 4;

FIG. 6 is an isometric illustration of a portion of a wall section and a portion of the base structure by way of exploded illustration to show the interfitting relationship of the base and wall structure;

FIG. 7 is a sectional view of a fragmentary sectional view illustrating the interfitting corner structure defined by adjacent walls of the shipping container;

FIG. 8 is a fragmentary vertical section of the base and wall structure illustrating the interfitting relationship with the wall catches and wall catch pockets or sockets; and FIG. 9 is a transverse sectional view of a portion of one of the wall structures illustrating the configuration of the wall catch pockets.

FIG. 10 is an exploded isometric illustration showing the basic structural components of the collapsible shipping container of the invention.

DETAILED DESCRIPTION OF PREFERRED EMBODIMENT

Figure 1:
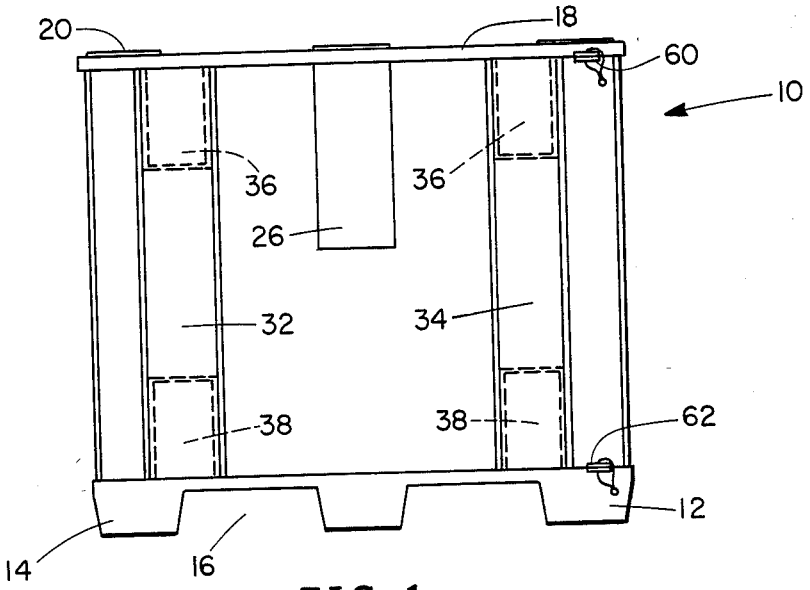
Figure 2:
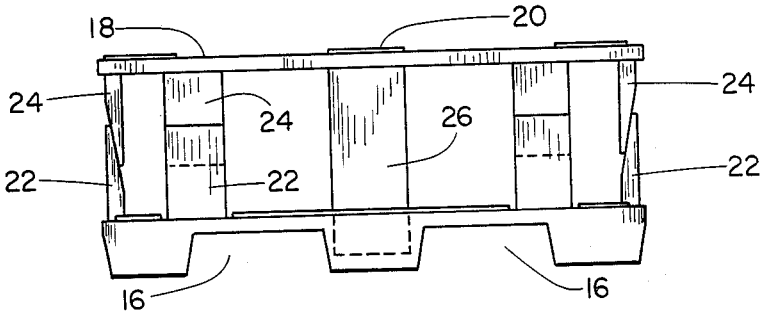
Figure 10:
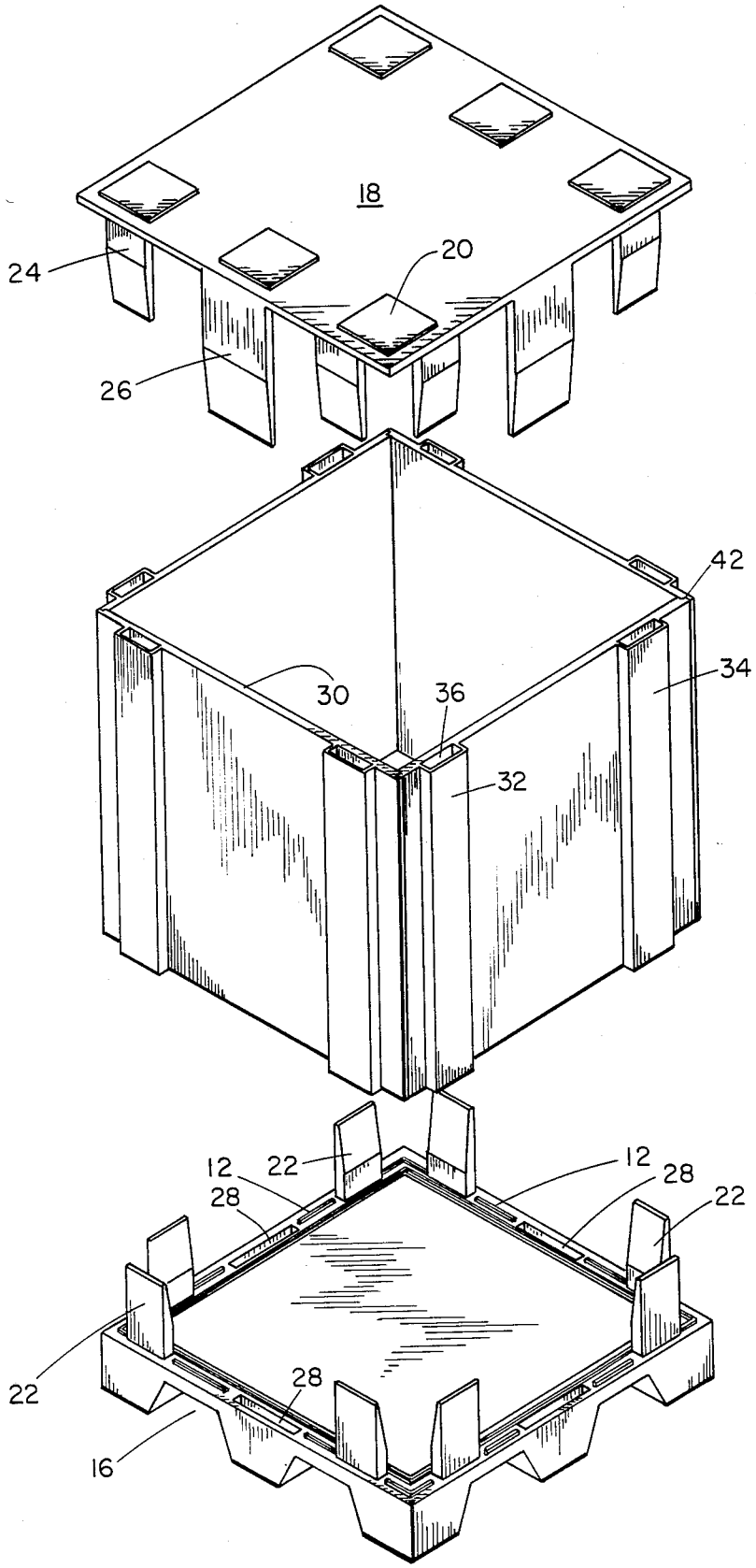

Referring now to the drawings and to the elevational views of FIGS. 1 and 2 and the exploded view of FIG. 10, a shipping container constructed in accordance with the present invention is illustrated generally at 10. The shipping container incorporates a base structure 12 having a plurality of support pads 14 that provide adequate support of the shipping container on an appropriate surface and define spaces 16 therebetween which receive the lift tines of a fork lift truck or other suitable means for lifting and handling the shipping container. The shipping container also incorporates a top wall structure 18 that is provided with a plurality of stack rails 20 which are positioned to receive the support pads 14 of other similar shipping containers. The shipping containers of this invention have sufficient structural integrity that they may be stacked several tiers high either in the assembled or collapsed conditions thereof without any damage to either the shipping containers or the products contained therein.

Figure 3:
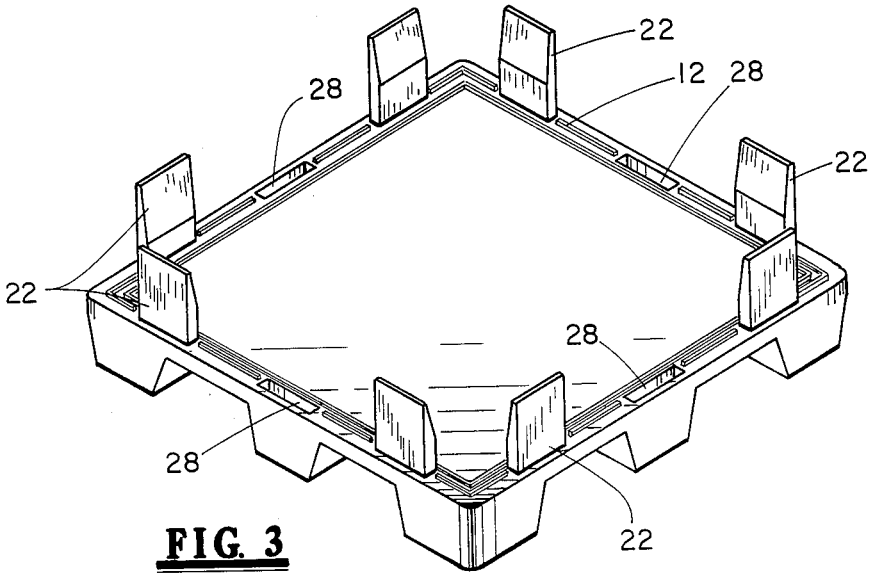

As is evident from the plan view of FIG. 3 and the elevational view of FIG. 2, the base structure 12 is provided with a plurality of upstanding wall catches 22 which are of generally rectangular cross-sectional configuration. The wall catches 22 are tapered at the upper portion thereof, and, as shown in FIG. 2 establish a matching or interfitting relation with corresponding downwardly projecting wall catches 24 of the top wall or cover 18. In the collapsed condition of the container as shown in FIG. 2 the interfitting wall catches 22 and 24 cooperate to form structural posts along the sides of the shipping container. The embodiment shown forms two structural posts along each side of the shipping container and thus provides efficient structural integrity for adequate support between the top wall and base structure.

The top wall structure 18 includes one or more shipping catches 26 which depend downwardly from each of the sides thereof. As shown in FIGS. 2 and 10, the shipping container includes one shipping catch 26 on each side. The base structure 12 is provided with shipping catch slots 28 which correspond to the shipping catches 26. In the collapsed condition of the container assembly as shown in FIG. 2, the shipping catches are received within respective ones of the shipping catch slots 28 and thus function as vertical load bearing post structures on each side of the shipping container to enhance weight supporting capability. Thus, the shipping catches cooperate with the wall catches 22 and 24 to provide efficient structural integrity in the collapsed condition of the shipping container. This feature enables the collapsed shipping container to be stacked a number of tiers high without any risk of damage due to application of weight in the collapsed condition thereof.

Figure 4:
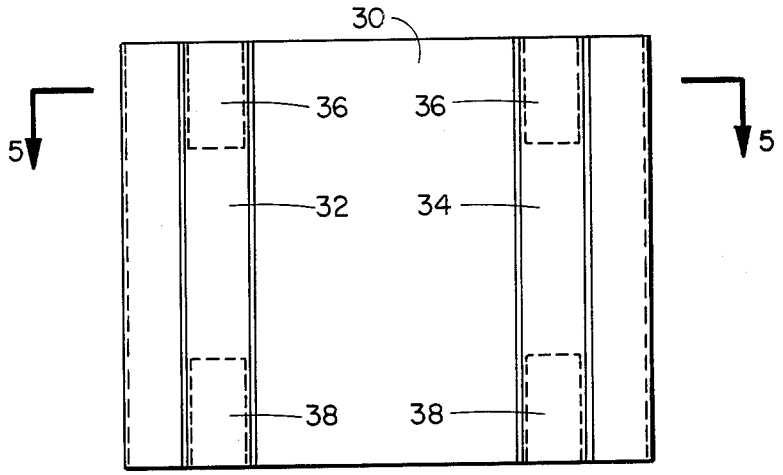
Figure 5:
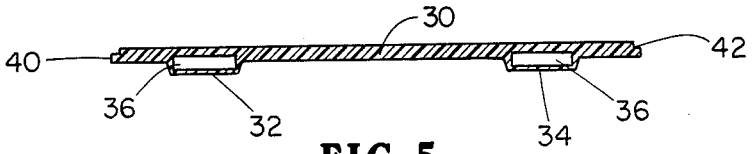

It should be borne in mind that the base structure and cover structure of the collapsible shipping container may be of square configuration as shown essentially in FIG. 3, or, in the alternative, may be of any other suitable configuration such as rectangular, octagonal, round, etc. The design of the cover and base, together with the wall structures, will make up a collapsible shipping container that may be efficiently utilized and handled wither in the assembled or collapsed condition thereof. As shown in FIG. 4 a plurality of container walls are provided as shown at 30. Each of the walls defines vertical structural ribs 32 and 34 which function as support posts to provide the shipping container with structural integrity to withstand vertical loads. Each of the structural ribs is provided with upper and lower pockets 36 and 38 as shown in broken lines. Pockets 36 and 38 are provided to receive respective wall catches of the base and cover structures. As illustrated in FIG. 5, the configuration of the structural ribs 32 and 34 are shown in relation to the wall structure 40 and the configuration of the wall catch pockets 36 and 38.

As is also evident from FIGS. 4 and 5, each of the wall sections is provided with vertical recesses 40 and 42 along the sides thereof. When the shipping container is assembled the vertical side edges of the wall structures interfit in the manner shown in detail in FIG. 7 to form a strong, substantially sealed weather tight joint at the corners. Inner and outer spill guard strips 41 and 43 are formed integrally with or otherwise connected to the base structure 12 and provide for engagement of the wall structure 30 in the manner shown in FIGS. 6 and 8 to provide further stabilization and strengthening of the wall structure and the corner joints defined between adjacent wall sections.

Figure 6:
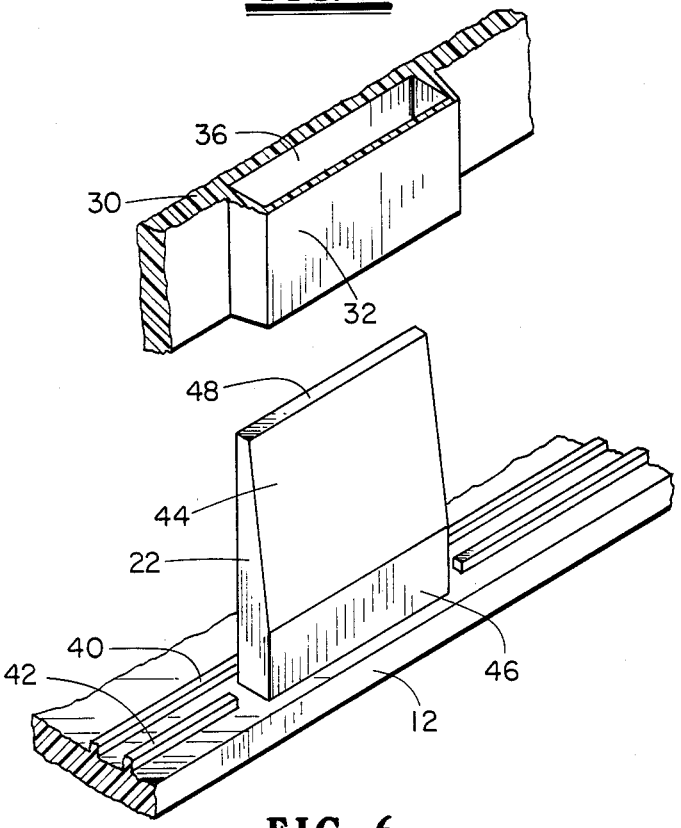
Figure 7:
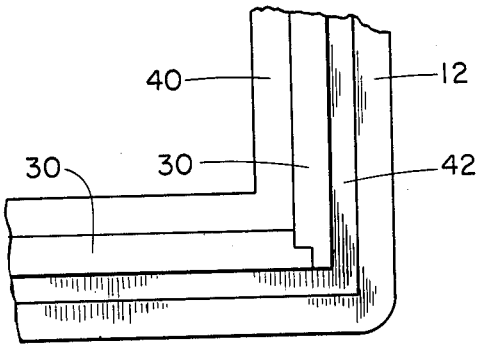
Figure 8:
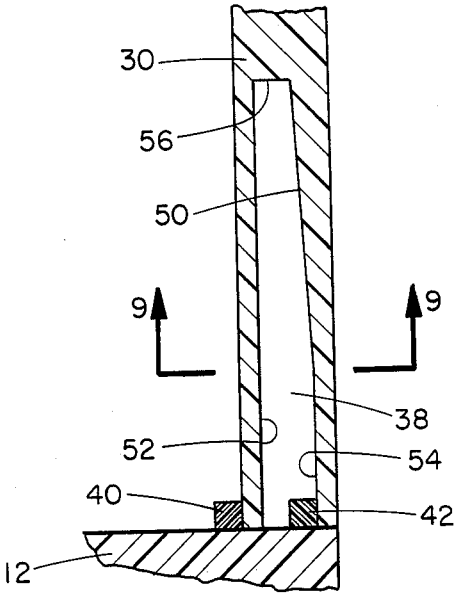
Figure 9:
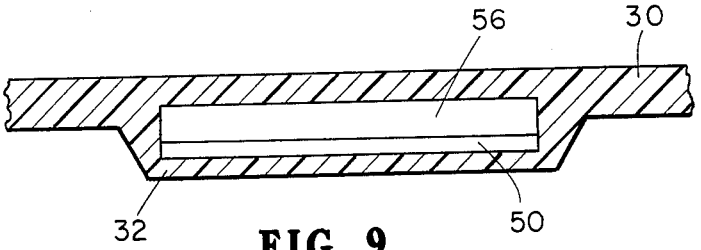

As shown in FIG. 6, each of the upstanding wall catches of the base structure are of tapered configuration and define a tapered surface 44 being inclined upwardly and inwardly from the outer planar surface 46 thereof. The upper end of each wall catch defines a planar, elongated surface 48. As shown in FIG. 8, the respective wall sockets or pockets 38 are of corresponding configuration, defining an inclined surface 50 which corresponds with the inclined or tapered surface 44 of the wall catch 22. The wall catch pocket also defines a pair of parallel vertical surfaces 52 and 54 corresponding to the front surface 46 and the planar rear surface of the respective wall catch. An upper planar surface 56 is formed which corresponds to the planar surface 48 of the respective wall catch. When the wall catch is received within the pocket 38 it substantially fills the pocket, bringing corresponding surfaces of the wall catch into load bearing contact with tapered surface 50 and transverse surface 56 of the wall catch pocket. This feature causes the wall structure of the shipping container to be effectively strengthened and therefore better able to withstand the forces of stacking even when the containers are filled with products of substantial weight.

The top wall of the collapsible container system is provided with depending wall catches which are essentially a mirror image of the wall catch structure shown in FIGS. 6 and 8. The upper wall catches substantially fill the pockets at the upper portions of the side walls and establish force transmitting relation in the same manner as discussed above. The resulting wall structure at both the upper and lower portions thereof is essentially of solid configuration, thus in essence defining post structures which provide efficient strengthening of the structural ribs 32 and 34 of each of the wall sections.

In the assembled condition of the collapsible container as shown in FIG. 1, the respective wall catches of the base and top wall are received in interfitting relation within respective pockets or receptacles formed in the respective structural ribs 32 and 34. There is formed therefor a collapsible container of rugged and simple construction that is capable of ready assembly and disassembly without the use of tools. During assembly of the container the base structure 12 is placed on a support platform such as a floor and, if desired, the products with which the container is to be filled are stacked onto the base. This feature permits ease of loading the container. Also, if desired, two or three walls of the container may be assembled to the base structure leaving one or two of the sides open to thereby permit efficiency of loading. After loading, the remaining walls are then brought into assembly with the base 12 and the corner joints thereof firmly established. The top wall or cover 18 with its depending wall catches are placed in assembly with the wall structure of each wall section. When completed, the container structure is quite rigid, has significant load carrying capability and is substantially sealed. Even when filled with articles of considerable weight, it is capable of being stacked several tiers high. The recesses 16 defined by the base allow easy handling of the collapsible container by means of a fork-lift truck or other suitable device. Assembly of the container is more clearly evident from a review of FIG. 10.

It is envisioned that the base, top wall or cover and side walls of the collapsible container assembly may be constructed of any suitable non-corrosive material such as fiberglas or any one of a number of suitable polymer materials. These components may be molded from fiberglas, polystyrene or other suitable materials for high strength, durability and corrosion resistance. In the event one of the structures of the container should become damaged and require repair it is not necessary to send the entire container system to a repair facility. A user would merely replace the damaged part with a serviceable part so that the container may be used without any significant down time. The damaged part then may be returned to a repair facility for repair thereof.

After shipping has occurred and the container is to be returned to the shipper the top wall or cover of the container will be removed from the walls and the walls will be removed from the base 12. After this has been done the walls are stacked on the base. The top cover is then lowered into assembly with the base, bringing the shipping catches into interlocking relation with the shipping catch slots 28 as shown in FIG. 2. When this has been done the shipping catches will restrain the top wall and base against relative transverse movement. Further, the wall catches will establish a force transmitting interfitting relationship as shown in FIG. 2. The tapered surfaces of the wall catches of the base and cover will be in engagement and therefore will function essentially as a rigid post, providing a load supporting capability. The shipping catches together with the wall catches will provide sufficient structural integrity in the collapsed condition of the shipping container that it will resist significant vertical force. The shipping containers may therefore be stacked several tiers high in the collapsed condition. The walls, being contained within the shipping container, will not be lost during further shipment and handling of the shipping container.

To protect the integrity of the shipping container during shipment and therefore protect the shipper against liability from pilferage or other loss of products, the cover and walls can be provided with seal retaining tabs such as shown at 60 and 62 in FIG. 1. These matching, aperture tabs are capable of receiving locking seals of any suitable character. Arrival of the shipping container at its destination with the seals intact will absolve the shipper from any liability in the event products are deemed to be missing when the container is opened by the receiver.

In view of the foregoing, it is quite clear that the present invention provides a novel, collapsible shipping container having a base, side walls and a cover that are molded or otherwise formed to a particular configuration. These structural components interfit to define a shipping container of exceptional strength, durability and simplicity of design. The shipping containers may be formed of a material which is corrosion resistant thereby rendering it serviceable for long periods of time. The base, side walls and cover may be integrally molded units which are readily and quickly formed at low cost during molding operations. The shipping containers may be formed of low cost materials without sacrificing structural integrity or serviceability. To facilitate ease of handling and to insure minimal storage and transportation space during return of the containers to the shipper. Also, in the collapsed condition of the shipping containers they are capable of being stacked a number of tiers high for conservation of storage and shipping space because of the structural integrity provided thereto by the interfitting shipping catches and wall catches. The present invention is therefore well adapted to attain all of the features and advantages hereinabove set forth together with other advantages which will become obvious and inherent from a description of the apparatus itself. It will be understood that certain combinations and subcombinations are of utility and may be employed without reference to other features and subcombinations. This is contemplated and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

What is claimed is:

1. A collapsible shipping container, comprising:

(a) base means of generally rectangular form;

(b) wall catch means projecting upwardly from said base means;

(c) a plurality of generally planar wall elements each forming upper and lower pocket means therein, said wall catch means of said base means being received within said lower pocket means to establish interconnected relation between said base means and said wall elements, said wall elements defining vertical external structural rib means, said upper and lower pocket means being defined within respective upper and lower ends of said external structural rib means;

(d) top cover means of generally rectangular form; and (e) wall catch means depending from said top cover and being received within said upper pocket means to establish interfitting relation between said top cover means and said wall elements.

2. A collapsible shipping container as recited in claim 1, wherein said base means, wall elements and top cover means are each in the form of substantially rigid integral construction.

3. A collapsible shipping container as recited in claim 1, wherein said wall elements form side edges that interlock with the side edges of adjacent wall elements to form substantially sealed corner structures of significant structural integrity.

4. A collapsible shipping container as recited in claim 1, wherein:

(a) said wall catch means are of tapered form; and (b) said upper and lower pocket means define tapered internal surface means being engaged by said tapered wall catch means in force transmitting relation, whereby said upper and lower wall catch means substantial fill said upper and lower pocket means and render said wall elements to substantially solid form for efficient structural integrity thereof.

5. A collapsible shipping container as recited in claim 4, wherein said wall catch means of said base means and said top cover means are disposed in force transmitting engagement in the collapsed condition of said shipping container.

6. A collapsible shipping container comprising:

(a) base means of generally rectangular form;

(b) wall catch means projecting upwardly from said base means;

(c) a plurality of generally planar wall elements each forming upper and lower pocket means therein, said wall catch means of said base means being received within said lower pocket means to establish interconnected relation between said base means and said wall elements, said wall elements defining vertical external structural rib means, said upper and lower pocket means being defined within respective upper and lower ends of said external structural rib means;

(d) top cover means of generally rectangular form;

(e) wall catch means depending from said top cover and being received within said upper pocket means to establish interfitting relation between said top cover means and said wall elements;

(f) shipping catch means depends from said top cover means; and (g) slot means is defined by said base means and receives said shipping catch means in the collapsed condition of said collapsible shipping container, said shipping catch means and said wall catch retain said wall elements within the collapsed shipping container.

7. A collapsible shipping container, comprising:

(a) base means of generally rectangular form;

(b) wall catch means projecting upwardly from said base means;

(c) a plurality of generally planar wall elements each forming upper and lower pocket means therein, said wall catch means of said base means being received within said lower pocket means to establish interconnected relation between said base means and said wall elements, said base means defining spaced spill guard strips near the outer periphery thereof, said wall elements being received between said spill guard strips to form a substantial seal preventing entry of liquid and solid contaminants into said collapsible shipping container;

(d) top cover means of generally rectangular form; and (e) wall catch means depending from said top cover and being received within said upper pocket means to establish interfitting relation between said top cover means and said wall elements.

8. A collapsible shipping container comprising:

(a) base means of generally rectangular form, said base means defining a plurality of upstanding wall catches spaced along the outer edges thereof;

(b) a cover structure of generally rectangular form having a plurality of wall catches depending therefrom;

(c) side wall means forming upwardly and downwardlly directed pockets for receiving respective wall catches of said base means and said cover means; and (d) in the collapsed condition of said shipping container said wall means being stacked on said base means and said cover means being assembled to said base means, bringing said wall catches into force transmitting structurally interfitting relation, in said collapsed condition said shipping container being of significantly reduced height for conservation of storage and shipping space in the collapsed condition thereof.

9. A collapsible shipping container as recited in claim 8 wherein:

(a) said base means forms slot means at each side thereof; and (b) shipping catch means depends from said cover means and is engageable within said slot means in the collapsed condition of said container to thus enclose said stacked side wall means to prevent loss thereof during shipment and handling in the collapsed condition of said shipping container.

10. A collapsible shipping container as recited in claim 8 wherein said wall means forms vertically oriented structural rib means, said structural rib means forming said upper and lower pocket.

11. A collapsible shipping container as recited in claim 8 wherein:

(a) said wall catch means is of rectangular configuration throughout a portion of the height thereof and forms tapered surface means extending along the remaining height thereof; and (b) said pocket means is of mating configuration with said wall catch means, thus forming an essentially solid wall structure when said wall means is in assembly with said base means and said cover means.

12. A collapsible shipping container as recited in claim 8, wherein:

(a) said base means defines spaced spill guard strips along the perimeter thereof said spaced spill guard strips extending upwardly from said base means and providing structural support for lower edges of said wall means and preventing water and other liquid from entering said collapsible container.

* * * * *